US006981432B2

(12) United States Patent
Williford et al.

(10) Patent No.: US 6,981,432 B2
(45) **Date of Patent: *Jan. 3, 2006**

(54) HOSE CLAMP TOOL

(75) Inventors: Richard Earl Williford, St Clair Shores, MI (US); George Frederick MacDonald, West Bloomfield, MI (US); Thomas Eric Pearson, Grosse Ile, MI (US); James Robert Panyard, Livonia, MI (US); Christopher B. Trombetta, Commerce Township, MI (US)

(73) Assignee: Ford Motor Company, Dearborn, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/908,044

(22) Filed: Apr. 26, 2005

(65) Prior Publication Data

US 2005/0178242 A1 Aug. 18, 2005

Related U.S. Application Data

(63) Continuation of application No. 10/604,955, filed on Aug. 28, 2003.

(51) Int. Cl.
*B25B 27/10* (2006.01)

(52) U.S. Cl. ..... 81/9.3; 29/243.56; 140/93.2

(58) Field of Classification Search ..... 81/9.3; 29/235, 239, 243.56, 278, 283.5, 229; 140/93.2
See application file for complete search history.

(56) References Cited

U.S. PATENT DOCUMENTS

| | | | | |
|---|---|---|---|---|
| 4,159,725 | A | 7/1979 | Bachmann et al. | |
| 4,449,429 | A | 5/1984 | Sauer et al. | |
| 4,702,001 | A | 10/1987 | Malm et al. | |
| 5,507,206 | A * | 4/1996 | Solski | 81/9.3 |
| 5,647,407 | A | 7/1997 | Scott et al. | |
| 5,769,133 | A | 6/1998 | Dyer et al. | |
| 6,164,162 | A | 12/2000 | Furundzic | |
| 6,363,602 | B1 | 4/2002 | Clark | |
| 6,634,258 | B2 | 10/2003 | Pool et al. | |
| 6,840,289 | B2 * | 1/2005 | Hillegonds | 140/93.2 |
| 6,907,802 | B2 | 6/2005 | Schneider | |
| 2004/0011161 | A1 | 1/2004 | Gmeilbauer | |

* cited by examiner

*Primary Examiner*—David B. Thomas
(74) *Attorney, Agent, or Firm*—Raymond L. Coppiellie; Brooks & Kushman P.C.

(57) ABSTRACT

A hose clamp installation tool and a method for installing a hose assembly. A first rod engages the clamp and releases the clamp from an open position to a closed position. A sensor indicates release of the clamp.

20 Claims, 4 Drawing Sheets

69
60
52
34
58
56
62
64
74
68
76
66
54
32
28
72
42
38
70
22
30
20
26
44
14
16
18

HOSE CLAMP TOOL

CROSS-REFERENCE TO RELATED APPLICATIONS

This application is a continuation of U.S. application Ser. No. 10/604,955 filed Aug. 28, 2003.

BACKGROUND OF THE INVENTION

1. Field of the Invention

The present invention relates to an apparatus for installing a hose clamp and a method for installing a hose assembly with the apparatus.

2. Background Art

Hoses are used to make connections between components of fluid systems. For example, hoses are used to connect vehicle coolant system components, such as a radiator or heater core, to an internal combustion engine. These hoses are made of rubber, polymeric elastomers, or another flexible material. Connections are made by installing the hose over a pipe or mating member that extends from a fluid system component.

A hose clamp is used to hold the hose firmly against the mating member to provide a fluid tight seal between the hose and the mating member. A hose clamp is a circular spring steel wire or band with radially extending tabs at each end of the wire. A hose clamp is set in a pre-expanded position and glued to the outer surface of a hose to facilitate installation. One type of pre-expanded hose clamp is the "clipless" type that incorporates a latching member for holding the clamp in an open position without a separate retaining clip.

Hose connections are often made in locations that are difficult to access, such as at an engine block water jacket point near the bottom of an engine block. Such locations are frequently difficult to see and inspect. If a clamp is not properly engaged, a watertight seal is not formed between the hose and the mating member. In the case of a coolant system, improper clamping can result in coolant leaks, engine overheating, warpage of the head of an engine block, and engine failure necessitating expensive repairs or engine replacement.

In the prior art, pliers were used to grasp and squeeze together the hose clamp tabs to disengage the latching member and permit the clamp to move from an open position to a clamped position. Such tools did not include a feedback mechanism to confirm that the clamp had in fact moved to the clamped position securing the hose. In addition, these tools typically could not be adjusted or rotated to facilitate access to hard-to-reach clamps and could not be adapted to left-handed or right-handed user preferences.

Recent efforts to develop a tool that incorporated a feedback mechanism, such as that in U.S. provisional patent application Ser. No. 60/417,894, unsuccessfully attempted to utilize a single rod design to release the clamp and provide feedback. This experimental tool included a single rod with a hook formed at one end. The hook is inserted into a clamp tab and when the user pulls on a lever, the hooked rod pulls on a spring and on the clamp tab. If sufficient force is applied, the latching member is disengaged, permitting the clamp to move from an open position to a closed position. Disengagement of the latching member also releases tension on the spring, causing the hooked rod to recoil or kickback past its initial position and actuate a sensor, thereby signaling closing of the clamp. These "inertia operated switch" tools released clamps inconsistently and did not provide reliable feedback that the clamp had closed. In addition, these tools did not accommodate ergonomic adjustments, such as rotating the position of the hook for easy engagement of the clamp.

Before the Applicants' invention there was a need for an apparatus to install hose clamps and to provide positive feedback indicating that the hose clamp had engaged the hose. Problems associated with the prior art as noted above and other problems are addressed by Applicants' invention as summarized below.

SUMMARY OF THE INVENTION

According to one aspect of the present invention, a hose clamp installation tool is provided that includes a hook for engaging a clamp and a rod located adjacent to the hook that releases the clamp. A sensor detects whether the clamp has shifted to a closed position. The sensor may be a proximity switch or a load cell.

The installation tool can be pneumatically or manually actuated. If the tool is pneumatically actuated a piston may be attached to the rod. Pressure applied to the piston drives the rod from an initial position into engagement with the clamp. A spring may also be provided that biases the rod to return it to an initial position. Alternately, an air cylinder may be coupled to the rod.

A trigger may be moved by the clamp when the clamp shifts from an open position to a closed position. A feedback rod may be located adjacent to the trigger. The feedback rod moves in response to the movement of the trigger when the clamp shifts from the open position to the closed position. One or more sensors can be used to detect movement of the feedback rod and indicate that the clamp has shifted to a closed position. A first sensor can be used to detect changes in the position of the rod and a second sensor can be used to detect changes in the position of the feedback rod.

A spool may be disposed around the rod and biased to a start position by a spool spring. The spool may be contacted by the feedback rod and moved from the start position when the feedback rod is actuated by the trigger. A sensor, such as proximity switch, can be mounted to detect movement of the spool and indicate the clamp has shifted to a closed position.

According to other aspects of the invention relating to the housing, the hook used to engage the clamp can be attached to a tubular housing. The tubular housing may also partially enclose the rod.

The tubular housing may be selectively connected to a handle in different positions to permit the hook to be positioned in a convenient orientation relative to the handle.

According to another aspect of the invention, a method for installing a hose assembly with the hose clamp installation tool is provided. The method begins by inserting the hook into an aperture of the clamp. A rod is advanced to disengage the clamp from an open position. A trigger is moved in response to disengaging the clamp. Movement of the trigger shifts the feedback rod. A sensor monitors the position of the feedback rod to indicate that the clamp has shifted to the closed position.

According to a final aspect of the invention, an acceptable hose assembly signal is generated when the time between sensing a change in the rod position and sensing the shifting of the feedback rod corresponds to an accepted time value.

DETAILED DESCRIPTION OF THE PREFERRED EMBODIMENT(S)

Figure 1:
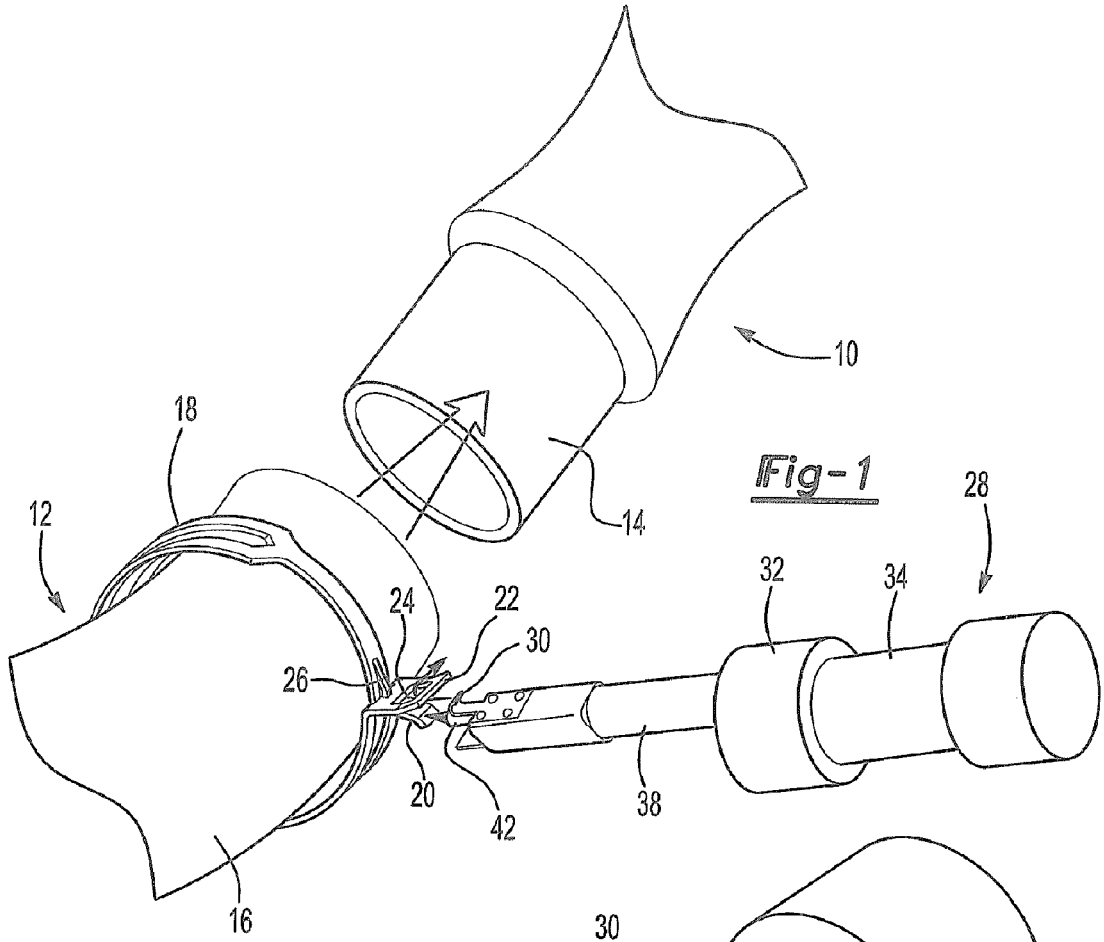
FIG. 1 is a perspective view of a hose clamp installation tool and a hose assembly before installation.

Referring to FIG. 1, an engine 10 and a hose assembly 12 are shown. The engine 10 includes a flange 14 that mates with the hose assembly 12. The hose assembly 12 includes a hose 16 and a clamp 18. The clamp 18 can be attached to the hose 16 with an adhesive. The clamp 18 is shown in an open position to facilitate sliding the hose 16 over the flange 14. The clamp 18 includes a first tab 20 and an aperture tab 22. The aperture tab 22 includes an aperture 24. A latch 26 engages the aperture tab 22 to hold the clamp 18 in an open position.

An installation tool 28 is also shown that includes a hook 30 that is received in the aperture 24 to allow the installation tool 28 to latch onto the clamp 18.

Figure 2:
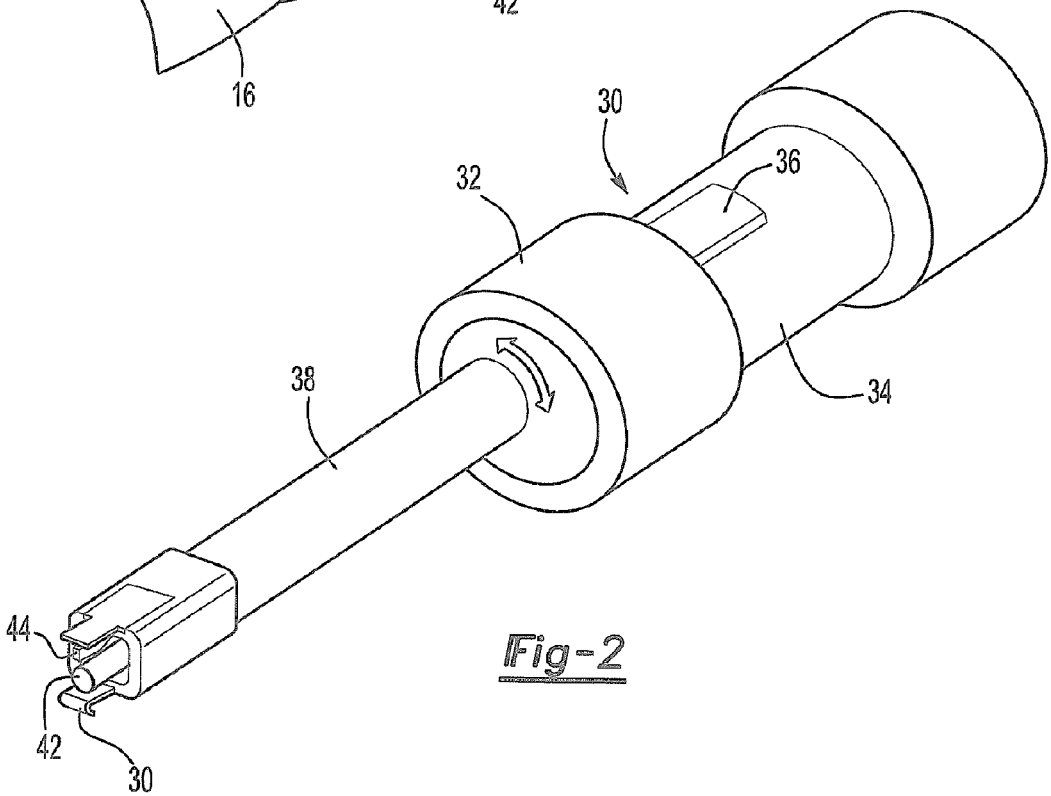
FIG. 2 is a perspective view of a hose clamp installation tool.

Referring to FIG. 2, the end of the installation tool 28 that engages the clamp 18 is shown more clearly. The installation tool 28 includes a housing 32. The housing 32 includes a handle 34 for grasping the installation tool 28. A switch 36 is located adjacent to the handle 34 that activates the installation tool 28 when engaged. A tubular housing 38 is rotatably attached to the housing 32. The hook 30 is attached to a distal end of the tubular housing 38. The tubular housing 38 at least partially encloses an unclamp rod 42 and a trigger 44.

Figures 3, 4, 5:
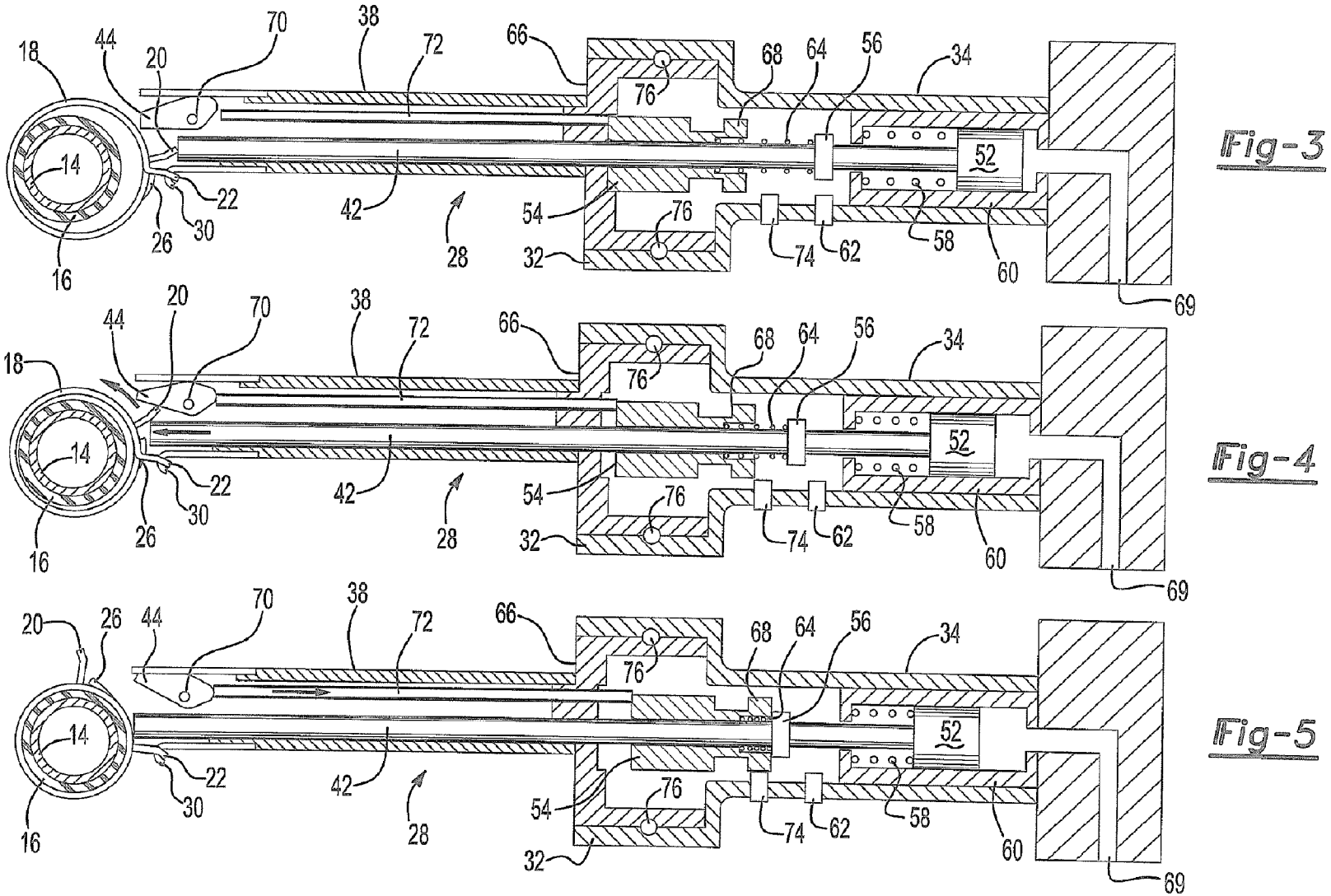
FIG. 3 is a section view of a pneumatic hose clamp installation tool with the unclamp rod in an initial position and the feedback rod in a start position.
FIG. 4 is a section view of a pneumatic hose clamp installation tool with the unclamp rod in an actuated position and the feedback rod in a partially shifted position.
FIG. 5 is a section view of a pneumatic hose clamp installation tool with the unclamp rod in an actuated position and with the feedback rod shifted.

Referring to FIG. 3, the installation tool 28 is shown with the hook 30 engaging a clamp 18 that is latched in an open position. The unclamp rod 42 is located adjacent to the first tab 20 of the clamp 18. A piston 52 is attached to an end of the unclamp rod 42. The unclamp rod 42 passes through a spool 54. A collar 56 is attached to the unclamp rod 42 between the spool 54 and the piston 52. The unclamp rod 42 passes through an unclamp spring 58 located between the piston 52 and a cylinder 60. The unclamp spring 58 biases the unclamp rod 42 to an initial position as shown. When the unclamp rod 42 is in the initial position, collar 56 is adjacent to a first sensor 62 that detects the position of the unclamp rod 42. The unclamp rod 42 also passes through a spool spring 64 located between the collar 56 and the spool 54. The spool spring 64 biases the spool 54 to a start position adjacent to a rotatable housing 66. When the spool 54 is in the start position, a spool collar 68 is not adjacent to a second sensor 74.

Referring to FIG. 4, the installation tool 28 includes a port 69 that is connected to a source of pressurized air. When the switch 36 is engaged, pressurized air enters the cylinder 60 and applies a force against the piston 52, causing the unclamp rod 42 to engage the first tab 20 of the clamp 18. As the unclamp rod 42 engages the first tab 20, the unclamp spring 58 is compressed and the collar 56 moves away from the first sensor 62. At the same time, the spool spring 64 is partially compressed between the collar 56 and the spool 54. When sufficiently advanced in the direction indicated by the arrow on the unclamp rod 42, the unclamp rod 42 releases the latch 26 and the clamp 18 is permitted to shift from an open position to a closed position as indicated.

Referring to FIG. 5, as the clamp 18 snaps to the closed position, the first tab 20 momentarily contacts the trigger 44. The trigger 44 then rotates about a pivot pin 70. As the trigger 44 rotates, it contacts a feedback rod 72. The feedback rod 72 advances and contacts the spool 54. The spool 54 moves away from the rotatable housing 66 and compresses the spool spring 64. The movement of the spool 54 causes the spool collar 68 to be shifted to a position adjacent to the second sensor 74, thereby providing feedback that the latch 26 has released and that the clamp 18 has shifted to the closed position. When the first tab 20 no longer contacts the trigger 44, the spool spring 64 biases the spool 54, feedback rod 72, and trigger 44 back to their respective start positions as shown in FIG. 3. The flow of pressurized air against the piston 52 is stopped when the switch 36 is released and the unclamp spring 58 exerts a biasing force on the unclamp rod 42, returning it to the initial position.

Also shown in FIG. 5, a bearing 76 is located between the housing 32 and the rotatable housing 66. The bearing 76 permits the rotatable housing 66 to rotate with respect to the housing 32. The tubular housing 38 is attached to and rotates with the rotatable housing 66. As a result, the hook 30 attached to the tubular housing 38 can be moved to a variety of positions relative to the housing 32.

Figure 6:
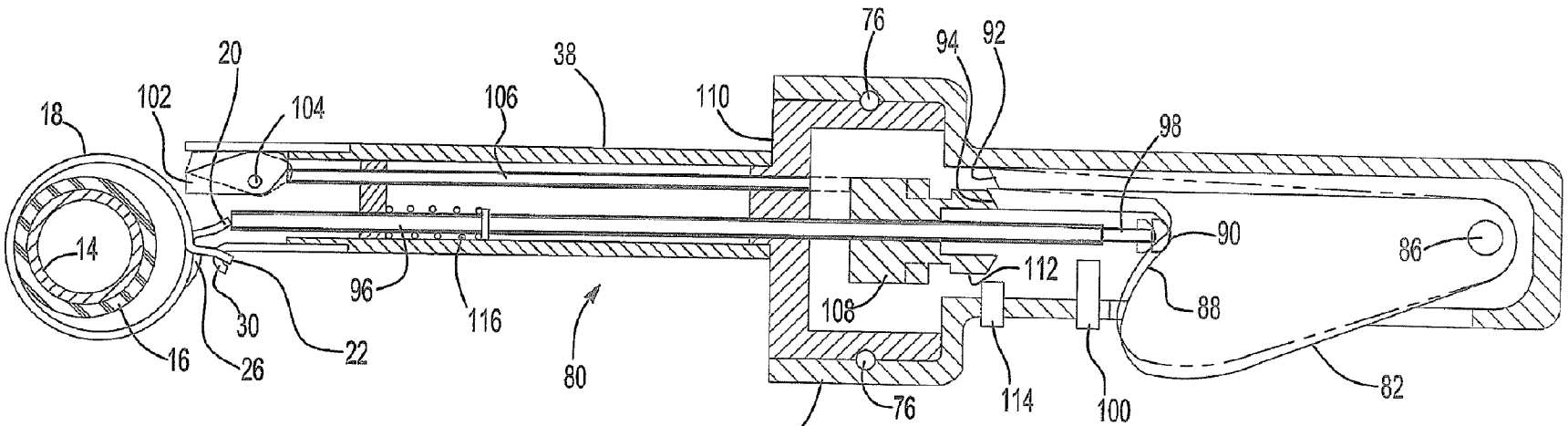
FIG. 6 is a section view of a manual hose clamp installation tool.

Referring to FIG. 6, a manual installation tool 80 is shown. This embodiment includes a handle grip 82. Handle grip 82 protrudes through a housing 84 and is held rotatably in place with a pin 86. The handle grip 82 includes a first surface 88 adjacent to a rod end 90 and a second surface 92 adjacent to a spool surface 94. When the handle grip 82 is engaged, the first surface 88 contacts the rod end 90 causing an unclamp rod 96 to engage the first tab 20 of the clamp 18. When the unclamp rod 96 engages the clamp 18, a narrow region 98 of the unclamp rod 96 is moved adjacent to a first switch 100, which detects the position of the unclamp rod 96. Also, the second surface 92 moves away from the spool surface 94.

As the clamp 18 snaps to the closed position, the first tab 20 momentarily contacts a trigger 102. The trigger 102 then rotates about a pivot pin 104. As the trigger 102 rotates, it contacts a feedback rod 106. The feedback rod 106 advances and contacts a spool 108. The spool 108 moves away from a rotatable housing 110. The movement of the spool 108 repositions a spool collar 112 adjacent to a second sensor 114, thereby providing feedback that the latch 26 has released and that the clamp 18 has shifted to a clamped position. When the handle grip 82 is released, the second surface 92 contacts the spool surface 94 and returns the spool 108, feedback rod 106, and trigger 102 to their respective start positions. Likewise, an unclamp spring 116 biases the unclamp rod 96 to return to its initial position.

Alternatively, the second sensor or sensor 74, 114 can be positioned to detect movement of the feedback rod 72, 106, thereby eliminating the need for the spool 54, 108. The second sensor 74, 114 could also be positioned to detect movement of the trigger 44, 102, thereby eliminating the need for the spool 54, 108 and the feedback rod 72, 106.

A successful installation signal may be generated only if the clamp 18 shifts from an open position to a closed position within a predetermined amount of time. An elapsed time is measured between sensing the shifting of the unclamp rod 42, 96 with first sensor 62, 100 and sensing the actuation of the trigger 44, 102 or feedback rod 72, 106 or spool 54, 108 with the second sensor 74, 114. If the elapsed time is within a predetermined time interval, a successful installation signal is generated. The successful installation signal can be used as an input to activate an indicator, such as a light or buzzer, increment a counter, or register the information in a database verifying that the clamp has been closed. Failure to obtain a successful installation signal could be used to halt a vehicle assembly line.

Figure 7:
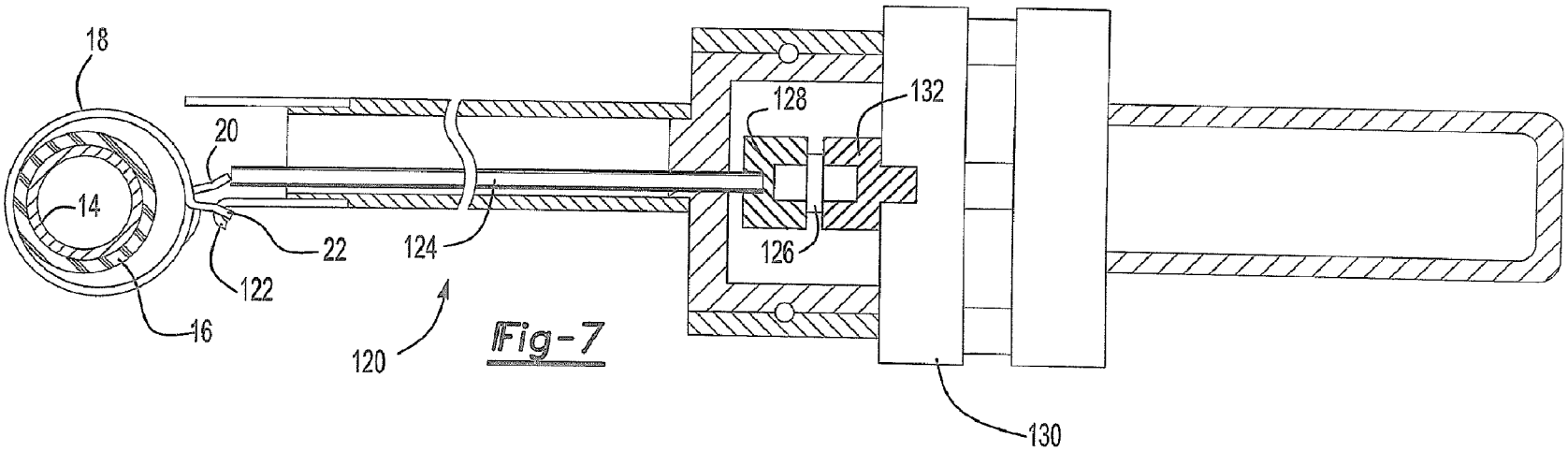
FIG. 7 is a section view of a second embodiment of a pneumatic hose clamp installation tool.

Referring to FIG. 7, another embodiment of a pneumatic hose clamp installation tool is shown. The installation tool 120 is shown with a hook 122 engaging a clamp 18 that is latched in an open position. An unclamp rod 124 is located adjacent to the first tab 20 of the clamp 18. The unclamp rod 124 is attached to a load cell 126 with a coupling 128. The load cell 126 is attached to an air cylinder 130 with a second coupling 132. When a switch is engaged, the air cylinder 130 is actuated and the unclamp rod 124 engages the first tab 20 of the clamp 18. The load cell 126 measures the force applied to the first tab 20 of the clamp 18. When the clamp 18 snaps to the closed position, force is no longer applied by the unclamp rod 124 to the first tab 20. When the switch is released, a spring inside the air cylinder 130 returns the unclamp rod 124 and the air cylinder 130 to their respective start positions. If the force measured by the load cell 126 is within a predetermined value range then the clamp 18 has shifted from an open position to a closed position. A successful installation signal is then generated.

Figure 8:
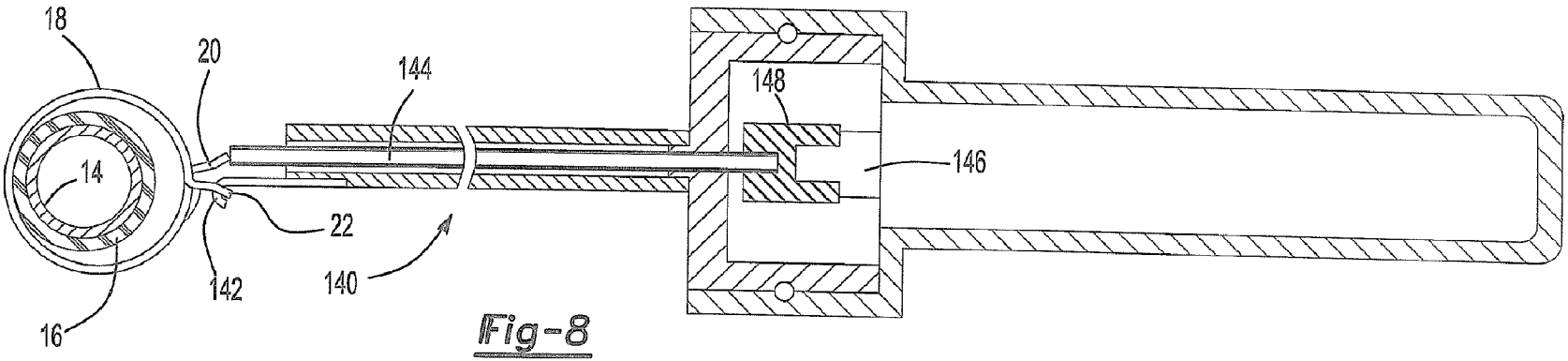
FIG. 8 is a section view of a second embodiment of a manual hose clamp installation tool.

Referring to FIG. 8, another embodiment of a manual hose clamp installation tool is shown. The installation tool 140 is shown with a hook 142 engaging a clamp 18 that is latched in an open position. An unclamp rod 144 is located adjacent to the first tab 20 of the clamp 18. The unclamp rod 144 is attached to a load cell 146 with a coupling 148. In this embodiment the unclamp rod 144 does not move to disengage the clamp 18. Instead, the unclamp rod 144 is used to pry against the first tab 20 of the clamp 18. The load cell 146 measures the force applied to the first tab 20. When the clamp 18 snaps to the closed position, force is no longer applied by the unclamp rod 144 to the first tab 20. If the force measured by the load cell 146 is within a predetermined value range then the clamp 18 has shifted from an open position to a closed position. A successful installation signal is then generated.

While the best mode for carrying out the invention has been described in detail, those familiar with the art to which this invention relates will recognize various alternative designs and embodiments for practicing the invention as defined by the following claims.

What is claimed is:

1. A hose clamp installation tool comprising:

a housing having a distal end;

an engagement feature disposed proximate the distal end for engaging a clamp;

a first rod disposed at least partially within the housing, the first rod having a first end disposed near the engagement feature for engaging the clamp to release the clamp from an open position and allow the clamp to shift to a closed position;

a trigger actuated by the clamp when the clamp shifts from the open position to the closed position;

a second rod that moves in response to actuation of the trigger; and a sensor that detects movement of the second rod and indicates release of the clamp.

2. The hose clamp installation tool of claim 1 wherein the sensor is a proximity switch.

3. The hose clamp installation tool of claim 1 where the engagement feature is a hook.

4. The hose clamp installation tool of claim 1 wherein the housing is rotatably connected to a handle for positioning the engagement feature relative to the handle.

5. The hose clamp installation tool of claim 1 wherein a first sensor detects a position of the first rod and a second sensor detects a position of the second rod to indicate release of the clamp.

6. The hose clamp installation tool of claim 1 wherein a piston is attached to the first rod for driving the first rod into engagement with the clamp.

7. The hose clamp installation tool of claim 1 wherein a first spring biases the first rod to return to an initial position.

8. The hose clamp installation tool of claim 1 wherein a spool is disposed around the first rod.

9. The hose clamp installation tool of claim 8 wherein a second spring biases the spool to a start position.

10. The hose clamp installation tool of claim 8 wherein the second rod contacts the spool.

11. The hose clamp installation tool of claim 8 wherein the sensor detects movement of the spool and indicates release of the clamp.

12. A hose clamp installation tool comprising:

a tubular housing having a distal end;

a hook disposed on the distal end for engaging a clamp;

a first rod at least partially disposed within the tubular housing and having first and second ends, the first end being disposed near the hook for engaging the clamp to release the clamp from an open position and allow the clamp to shift to a closed position and the second end being disposed opposite the first end;

a sensor disposed adjacent to the second end that detects force applied when the first end engages the clamp and indicates release of the clamp when no force is detected; and an actuator disposed adjacent to the sensor that moves the first rod to engage the clamp.

13. The hose clamp installation tool of claim 12 wherein the sensor is a load cell.

14. The hose clamp installation tool of claim 12 wherein the tubular housing is rotatably connected to a handle for positioning the hook relative to the handle.

15. The hose clamp installation tool of claim 12 wherein the actuator is pneumatically powered.

16. A hose clamp installation tool comprising:

a housing having a distal end;

an engagement feature disposed proximate the distal end for engaging a clamp;

a rod disposed in a fixed position relative to the housing, the rod having a first end and a second end disposed opposite the first end, the first end being disposed proximate the engagement feature for engaging the clamp to release the clamp from an open position to allow the clamp to shift to a closed position; and a sensor disposed adjacent to the second end that detects force when the first end engages the clamp.

17. The hose clamp installation tool of claim 16 wherein the sensor indicates release of the clamp when no force is detected.

18. The hose clamp installation tool of claim 16 wherein the sensor is a load cell.

19. The hose clamp installation tool of claim 16 wherein the housing is rotatably connected to a handle for positioning the engagement feature.

20. The hose clamp installation tool of claim 16 where the engagement feature is a hook.

* * * * *